United States Patent [19]

Brandt et al.

[11] 4,234,769

[45] Nov. 18, 1980

[54] ELECTRICAL SWITCH HAVING A FLOATING BRIDGE MEMBER

[75] Inventors: Gert M. Brandt, Brønshøj; Søren R. Hansen, Ballerup, both of Denmark

[73] Assignee: Aktieselskabet MEC Mekanisk Elektrisk Compagni af 1975, Ballerup, Denmark

[21] Appl. No.: 11,699

[22] Filed: Feb. 12, 1979

[30] Foreign Application Priority Data

Feb. 22, 1978 [DK] Denmark ..... 785/78

[51] Int. Cl.[3] ..... H01H 13/26

[52] U.S. Cl. ..... 200/67 DB; 200/243; 200/246

[58] Field of Search ..... 200/67 DB, 67 DE, 159 A, 200/159 R, 83 P, 243, 246

[56] References Cited

U.S. PATENT DOCUMENTS

| | | | |
|---|---|---|---|
| 3,200,227 | 8/1965 | Karch | 200/286 |
| 3,699,276 | 10/1972 | Atakkaan | 200/159 R |
| 4,064,381 | 12/1977 | Mullen | 200/243 |

FOREIGN PATENT DOCUMENTS

| | | | |
|---|---|---|---|
| 2360167 | 6/1975 | Fed. Rep. of Germany | 200/67 DB |
| 1452324 | 10/1976 | United Kingdom | 200/67 DB |

*Primary Examiner*—John W. Shepperd

*Attorney, Agent, or Firm*—Le Blanc, Nolan, Shur & Nies

[57] ABSTRACT

In an electrical switch including a housing and a button in which the button, by means of a manual depression thereof in a single direction is movable relative to the housing between two positions and during this movement causes a snap spring inserted in the button to slip from a first extreme position to a second one, the snap spring is set up or interlocked between two bearings or seats provided in opposite walls of the housing. The central part of the snap spring is arranged in a bridge member which carries resilient contact fingers. The bridge member is further arranged with a two-sided clearance in a recess provided in the button. The switch overcomes the problems of microphonic noise generated by any movement between the button and the housing and reduces considerably the contact resistances at the contact points due to a scrabing movement between the metal parts establishing the electrical connections.

1 Claim, 4 Drawing Figures

ELECTRICAL SWITCH HAVING A FLOATING BRIDGE MEMBER

The present invention is related to an electrical switch including a housing and a button, which button, by means of a manual depression thereof in a single direction, is movable relative to the housing between two positions and during this movement causes a snap spring inserted in the button to slip from a first extreme position to a second one.

Switches of the abovementioned kind are disclosed in published German patent application No. 10 42 071. In this prior art switch the middle or central part of the snap spring is placed in a bearing in the button whereas the two ends of the spring is set up between two bearings or seats of a metal strap, which further serves as a contact member adapted to establish a connection between either a first or a second pair of contact pins. Concerning switches of that kind the contact member, to be capable of retaining the snap spring inserted therein, necessarily has to be made of a stiff piece of metal, which has the effect that the kind of engagement between the contact member and the contact pins becomes a pure touching contact, which is established without having one piece of metal in the switch sliding on or scrabing against another piece of metal. A pure touching contact of that kind is less reliable than a contact established during scrabing, because dust particles or an oxide film may increase the contact resistance considerably and will not be removed or be penetrated respectively as it happens during scrabing. Further, it has been proven that the prior art switches, when employed in a telephone circuit, give rise to microphonic noise, which is a drawback too.

It is an object of this invention to provide an electrical switch of the firstmentioned kind, in which the discussed drawbacks are prevented. According to the present invention this is obtained by having the snap spring set up like a bow between two bearings or seats in opposite walls of the housing, by inserting the central part of this spring in a bridge member carrying resilient contact fingers and by having the the bridge member arranged with a two-sided clearance in a recess provided in the button.

Thereby is achieved on the first hand that the nescessity of making the contact member stiff is dropped because it no longer has to carry the fixed snap spring but instead can be made resilient so that a scrabing engagement can be obtained, and on the second hand that the switch to a considerable extent involves less microphonic noise, which is believed to be due to the fact that the snap spring, which establishes the contact pressure, no longer, as the case is in the prior art embodiment, is positioned between a movable button and the contact pins built-in in the housing, but, as in the switch according to the invention, acts between bearings or seats in the housing and contact pins in the same housing, and owing to the bridge member's clearance in the button, does not touch it at all.

Figure 1:
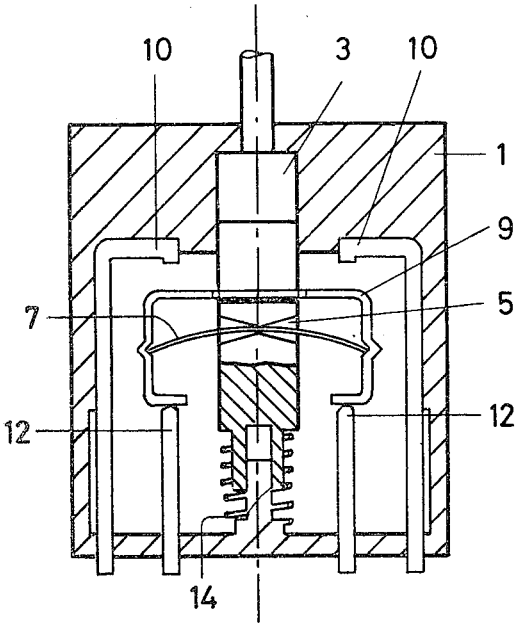
FIG. 1 PRIOR ART
Figure 4:
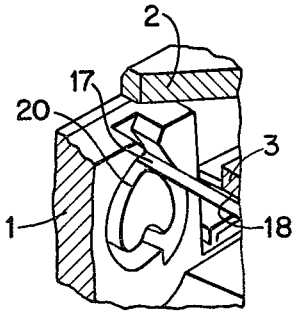
Figure 2:
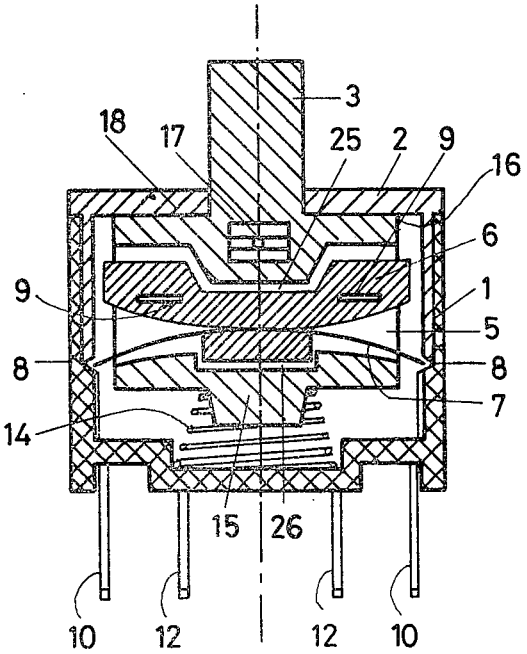
Figure 3:
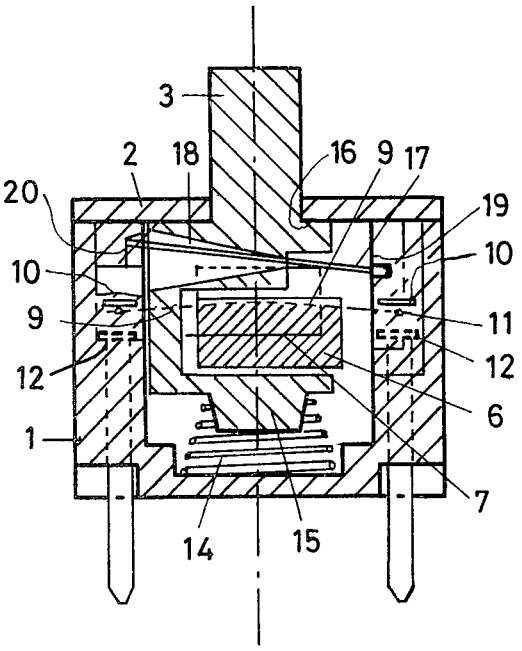

The present invention will now be described in details below having reference to the drawing, in which FIG. 1 is a sectional view of a prior art electrical switch, and FIG. 2 and 3 are sectional views, in two orthogonal directions, of an embodiment of an electrical switch according to the invention, and FIG. 4 is a break-away detail perspective view of the heartshaped track which fixes one end of a setting rod.

Referring to FIG. 1 of the drawing showing a prior art electrical switch reference numeral 1 designates a housing, in which a push button 3 from outside is longitudinally displacable under the influence of a coiled spring 14. A snap spring 7 is at its middle or central part fixed in a through-hole in the button 3. The extreme ends of the snap spring 7 are set up in such a way in bearings or seats in a metal strap 9 worked out as a contact member that the snap spring 7 forms a bow or arc which either can turn up or down. In FIG. 1 the bow is shown turning up, in which case the metal strap comes to engagement with contact pins 12. By a downwards pressure on the button 3 the snap spring 7 slips or snaps to its turned down position and when the button is released it is forced upwards by the coiled spring 14 until the contact member 9 abuts the contact pins 10 built-in in the housing 1. It is apparent that because of the fact that the contact member 9 has the form of a metal bow which has to keep the snap spring 7 biased it gains the character of a stiff bow which is guided to engagement with the pairs of contact pins 10 or 12, respectively. This engagement or touchment will establish a connection between the contact pins 10 or 12, respectively, provided this is not prevented by a dust particle or an oxide film formed on the metal parts. Any kind of movement between the button 3 and the housing 1 will expose the touch-like engagement between the contact pins and the contact member to movements like those existing between the carbon particles in a carbon microphone, which is believed to be a possible explanation of the noise sensitivity of that kind of switches.

An embodiment of an electrical switch according to the invention is illustrated in FIGS. 2 and 3, in which aquivalent parts bear the same reference numerals as in FIG. 1.

A push button 3 is arranged in a housing 1 under a cover 2. The button 3 has a recess 5, in which a bridge member 6 is placed. The recess is in the direction of movement of the button so much wider than the bridge member 6, that room for clearance 25 and 26 is left above as well as beneath the bridge member 6. In this member is inserted a snap spring 7, both ends of which are set up between bearings or seats 8 in opposite walls of the housing 1. The snap spring is embodied as a flat spring and is plane when not being set up.

In the bridge member 6 is inserted contact springs 9 the contact surfaces of which is provided with two-sided protrusions which, when engaging the contact fingers 10 and 12, respectively, because of the springing action of the contact springs 9 will scrabe against and thereby clean the contact surfaces and thus prevent dust and oxide films in increasing the contact resistance.

A setting rod 17 is inserted in a through-hole 18 of the button 3 and supported in one end thereof by a rocker bearing 19 in the housing and in the other end thereof by a heart-shaped track 20 (see FIG. 4) serving to fix the setting rod 17 in one of two possible set-positions, an upper one and a lower one, respectively. A coiled spring 14 is arranged between the bottom of the housing and a post 15 on the button 3.

The electrical switch of the invention operates as follows. When the button 3 is in its upper position, as illustrated on the drawing, the contact springs 9 having performed a scraping or sliding movement due to bending of the contact springs establish a connection with the contact pins 10. In this position the button 3 is fixed by the setting rod 17, which as a lever is lifted to its upper position and kept to the upper fixing point of the heart-shaped curve. When pushing the button downwards the flat spring 7 accompanied by an audible click will slip or snap from its shown turned up position to a turned down position. During this movement the coiled spring 14 will be compressed while the contact springs 9 will interrupt the electrical connections between the contact pins 10 and instead with a scraping or sliding movement establish electrical connections between the contact pins 12. Simultaneously, the setting rod will be guided from its upper fixing point in the heart-shaped track to its lower fixing point. The dimensions of the switch have now been laid down so that the snap spring 7 in this position keeps the bridge member 6 so floating in the recess 5 that approximately equal spaces or gaps 25 and 26 are left between said member and the button 3.

When the button, provided it being in its lower position, again is depressed, e.g. manually by way of a fingertip, the lower fixing point of the setting rod will be released in the heart-shaped track, and when the depression again discontinues, then the coiled spring 14 pushes the button back to the upper position shown while the space or gap 26 is dropped temporarily. By this action the setting rod will snap to its upper fixing point in the heart-shaped track and the connection to the contact pins 10 will be reestablished, which also applies to the space or gap 26.

We claim:

1. An electrical switch including a housing and a button, which button, by means of a manual depression in a single direction, is movable relative to the housing between two positions and during this movement causes a snap spring inserted in the button to slip from a first extreme position to a second one, characterized in that said snap spring (7) is set up to a bow between two bearings or seats (8) provided in opposite walls of the housing, that a central part of said snap spring is placed in a bridge member (6) carrying resilient contact fingers (9), and that said bridge member (6) is arranged with a two-sided clearance (25,26) in a recess provided in the button (3).

* * * * *